US011896051B2

(12) United States Patent
Taurino

(10) Patent No.: US 11,896,051 B2
(45) Date of Patent: Feb. 13, 2024

(54) AEROSOL-GENERATING SYSTEM COMPRISING INDIVIDUALLY ACTIVATABLE HEATING ELEMENTS

(71) Applicant: PHILIP MORRIS PRODUCTS S.A., Neuchatel (CH)

(72) Inventor: Irene Taurino, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 577 days.

(21) Appl. No.: 17/262,303

(22) PCT Filed: Jul. 10, 2019

(86) PCT No.: PCT/EP2019/068605
§ 371 (c)(1),
(2) Date: Jan. 22, 2021

(87) PCT Pub. No.: WO2020/020647
PCT Pub. Date: Jan. 30, 2020

(65) Prior Publication Data

US 2021/0259309 A1 Aug. 26, 2021

(30) Foreign Application Priority Data

Jul. 26, 2018 (EP) ..... 18185754

(51) Int. Cl.
*A24F 40/42* (2020.01)
*A24F 40/53* (2020.01)
(Continued)

(52) U.S. Cl.
CPC ..... *A24F 40/42* (2020.01); *A24F 40/46* (2020.01); *A24F 40/53* (2020.01); *A24F 40/57* (2020.01)

(58) Field of Classification Search
None
See application file for complete search history.

(56) References Cited

U.S. PATENT DOCUMENTS 5,179,966 A 1/1993 Losee
5,372,148 A 12/1994 McCafferty
(Continued)

FOREIGN PATENT DOCUMENTS

JP 2005-049815 2/2005
JP 2016-178937 10/2016
(Continued)

OTHER PUBLICATIONS

Office Action issued in Europe for Application No. 23167451.6 dated Jul. 21, 2023 (7 pages).
(Continued)

*Primary Examiner* — Tho D Ta
(74) *Attorney, Agent, or Firm* — Mueting Raasch Group

(57) ABSTRACT

There is provided aerosol-generating system (200) comprising a cartridge (100). The cartridge comprises a heater assembly comprising at least four individually activatable heating elements (116, 118 . . . 140) arranged in an array. There is an aerosol-forming substrate on each of the heating elements. The system also comprises an aerosol-generating device (201) configured to engage the cartridge. The aerosol-generating device comprises a power supply (206) and control circuitry (212). The control circuitry is configured to control a supply of power from the power supply to each of the heating elements to generate an aerosol. The control circuitry is configured to activate the heating elements sequentially such that no two spatially adjacent heating elements are activated consecutively.

13 Claims, 3 Drawing Sheets

(51) Int. Cl.
*A24F 40/46* (2020.01)
*A24F 40/57* (2020.01)

(56) References Cited

U.S. PATENT DOCUMENTS

| | | | | |
|---|---|---|---|---|
| 7,003,240 | B2 | 2/2006 | Omoto | |
| 9,554,598 | B2 | 1/2017 | Egoyants | |
| 9,943,114 | B2 | 4/2018 | Batista | |
| 10,834,968 | B2 | 11/2020 | John | |
| 2008/0092912 | A1* | 4/2008 | Robinson | A24F 40/42 131/200 |
| 2014/0360515 | A1* | 12/2014 | Vasiliev | A24F 40/46 131/329 |
| 2016/0044963 | A1 | 2/2016 | Saleem | |
| 2016/0295922 | A1* | 10/2016 | John | A24B 15/16 |
| 2017/0143042 | A1* | 5/2017 | Batista | A24F 40/42 |
| 2017/0164657 | A1* | 6/2017 | Batista | A24F 40/42 |
| 2017/0303588 | A1 | 10/2017 | Batista | |
| 2017/0340010 | A1 | 11/2017 | Bilat | |
| 2018/0021328 | A1 | 1/2018 | Myers | |
| 2018/0104214 | A1* | 4/2018 | Raichman | A61P 43/00 |

FOREIGN PATENT DOCUMENTS

| | | |
|---|---|---|
| JP | 2017-520263 | 7/2017 |
| JP | 2018-504127 | 2/2018 |
| WO | WO 2005/120614 | 12/2005 |
| WO | WO 2015/006652 | 1/2015 |
| WO | WO 2016/120344 | 8/2016 |
| WO | WO 2016/145075 | 9/2016 |

OTHER PUBLICATIONS

Office Action issued in Japan for Application No. 2021-501051 dated Apr. 24, 2023 (5 pages). English translation included.
Search Report and Written Opinion for PCT/EP2019/068605 filed Oct. 25, 2019 (13 pages).
Partial European Search Report for Application No. 18185754.1 dated Dec. 3, 2018 (10 pages).
Extended European Search Report for Application No. 18185754.1 dated Mar. 15, 2019 (8 pages).
International Preliminary Report on Patentability for PCT/EP2019/068605 dated Feb. 4, 2021 (10 pages).
Sims et al., "Nicotine Aerosol Generation from Thermally Reversible Zinc Halide Complexes Using the Staccato System,", Drug Development and Industrial Pharmacy, 34:936-942, 2008 (7 pages).

* cited by examiner

AEROSOL-GENERATING SYSTEM COMPRISING INDIVIDUALLY ACTIVATABLE HEATING ELEMENTS

This application is a U.S. National Stage Application of International Application No. PCT/EP2019/068605 filed Jul. 10, 2019, which was published in English on Jan. 30, 2020 as International Publication No. WO 2020/020647 A1. International Application No. PCT/EP2019/068605 claims priority to European Application No. 18185754.1 filed Jul. 26, 2018.

The invention relates to an aerosol-generating system comprising individually activatable heating elements. Specifically, the invention relates to an aerosol-generating system comprising a cartridge with individually activatable heating elements.

WO 2005/120614 relates to a device which aims to deliver precise, reproducible and/or controlled amounts of a physiologically active substance such as nicotine. The device comprises a cartridge which includes multiple foil heating elements with a substance disposed on the heating elements, and a power source configured to supply power to the foil heating elements. In use, a user puffs on the device and causes a flow of air through the device. Heat produced by a heating element thermally vaporises the substance disposed on the heating element. The vaporised substance condenses in the air flow of air to form a condensation aerosol. The aerosol is subsequently inhaled by the user.

One potential problem with the device disclosed in WO 2005/120614 is that the substance on a given heating element may be preheated by the activation of a spatially proximal, or a spatially adjacent heating element. Disadvantageously, this may increase the likelihood of thermal decomposition of the substance on the heating element. This is because preheating the substance may cause the substance to be heated for longer than the substance would otherwise be heated for, or the preheating may cause the heating element to reach a higher temperature than the heating element would otherwise reach, or both.

It is an objective of the invention to provide an improved aerosol-generating system in which the likelihood of thermal decomposition of an aerosol-forming substrate is reduced.

According to a first aspect, there is provided an aerosol-generating system comprising a cartridge. The cartridge comprises a heater assembly comprising at least four individually activatable heating elements arranged in an array. There is an aerosol-forming substrate on each of the heating elements. The system also comprises an aerosol-generating device configured to engage the cartridge. The aerosol-generating device comprises a power supply and control circuitry. The control circuitry is configured to control a supply of power from the power supply to each of the heating elements to generate an aerosol. The control circuitry is configured to activate the heating elements sequentially such that no two spatially adjacent heating elements are activated consecutively.

As used herein, the term "array" may refer to a linear array. That is, the term "heating elements arranged in an array" may refer to a single row of heating elements. Alternatively, the term "array" may refer to a two-dimensional array. That is, the term "heating elements arranged in an array" may refer to a two-dimensional array, or grid, of heating elements, for example an array of twelve heating elements, arranged as two adjacent rows of six heating elements, in a single plane. Alternatively, the term "array" may refer to a three-dimensional array.

As used herein, the term "aerosol-forming substrate" may be used to mean a substrate capable of releasing volatile compounds that can form an aerosol. The volatile compounds may be released by heating the aerosol-forming substrate. The aerosols generated from aerosol-forming substrates may be visible or invisible and may include vapours (for example, fine particles of substances, which are in a gaseous state, but that are ordinarily liquid or solid at room temperature). The aerosol-forming substrate may comprise a liquid at room temperature. The aerosol-forming substrate may comprise solid particles at room temperature.

The aerosol-forming substrate may be, or may comprise, a solid at room temperature. The aerosol-forming substrate may comprise a nicotine source. The aerosol-forming substrate may comprise a nicotine source and at least one of vegetable glycerin, propylene glycol and an acid. A suitable acid may comprise one or more of a lactic, benzoic, levulinic, or pyruvic acid. In use, one or more of vegetable glycerin, propylene glycol and an acid may evaporate together with nicotine from the nicotine source. Advantageously, the vaporised vegetable glycerin, propylene glycol and/or acid may coat or envelop the vaporised nicotine. This may increase the average aerosol particle size delivered to the user and therefore improve the efficiency of nicotine delivery into the lungs as there are likely to be fewer exhaled aerosol particles.

The use of an aerosol-forming substrate which is solid at room temperature advantageously reduces the likelihood of leakage or evaporation of the aerosol-forming substrate during storage. The aerosol-forming substrate can also be provided in a more physically stable form and there is therefore a lower risk of contamination or degradation than for liquid aerosol-forming substrate sources.

The aerosol-forming substrate may comprise a gel, or a paste, or both a gel and a paste. As used herein, gels may be defined as substantially dilute cross-linked systems which exhibit no flow when in a steady state. As used herein, a paste may be defined as a viscous fluid. For example, a paste may be a fluid which, at rest, has a dynamic viscosity greater than 1 Pa S, or 5 Pa S, or 10 Pa S. Advantageously, the use of an aerosol-forming substrate which includes a gel, paste, solid, or a combination thereof, may remove the need for an additional porous matrix to retain the aerosol-forming substrate.

There may be an associated portion of aerosol-forming substrate for each heating element. That is, a specific heating element may be configured to heat a specific portion of aerosol-forming substrate. For example, a heating element may be configured to heat a layer of aerosol-forming substrate in contact with said heating element.

There may be aerosol-forming substrate in direct contact with each heating element. Advantageously, this may increase the efficiency of heat transfer from the heating element to the aerosol-forming substrate.

Each heating element is individually activatable. Advantageously, this allows the control circuitry to implement a given order of activation of the heating elements.

The control circuitry is configured to activate the heating elements sequentially such that no two spatially adjacent heating elements are activated consecutively. Advantageously, this may minimise preheating of the heating elements. That is, this may minimise the heating of a given heating element before the given heating element is activated. This may reduce the likelihood of thermal decomposition of the aerosol-forming substrate.

In this context, two heating elements are "spatially adjacent heating elements" if there are no intermediate heating elements positioned between the two heating elements.

In this context, "two consecutively activated heating elements" may refer to an $n^{th}$ heating element and an $m^{th}$ heating element in a single cartridge which are activated without another heating element being activated between the activation of the $n^{th}$ and $m^{th}$ heating elements. In this context, "heating" a given heating element refers to the activation of the given heating element. That is, heating the given heating element refers to supplying power to the heating element such that the heating element reaches an operational temperature. Consecutively heated, or activated, heating elements may be heated during different smoking sessions, for example on different days. Advantageously, not activating two spatially adjacent heating elements consecutively may minimise preheating of the heating elements. That is, this may minimise the heating of a heating element before power is supplied to the heating element to heat it to an operational temperature.

The control circuitry may be configured to activate the heating elements in an order which maximises the minimum distance between any two consecutively activated heating elements. For a given number of heating elements, there may be more than one order which maximises the minimum distance between any two consecutively activated heating elements. Advantageously, this may reduce the heating of a given heating element before power is supplied to the given heating element to heat it to an operational temperature. This may reduce the likelihood of thermal decomposition of the aerosol-forming substrate.

The control circuitry may be configured to activate the heating elements sequentially such that, following activation of a first heating element of the heating elements in the array, each subsequently activated heating element in the array is as far as possible from a most recently activated heating element in the array. In this context, "as far as possible" may refer to the largest possible spatial distance. Advantageously, this may reduce the heating of a given heating element before power is supplied to the given heating element to heat it to an operational temperature. This may reduce the likelihood of thermal decomposition of the aerosol-forming substrate.

According to a second aspect, there is provided an aerosol-generating system comprising a cartridge. The cartridge comprises a heater assembly comprising at least three individually activatable heating elements arranged in an array. There is an aerosol-forming substrate on each of the heating elements. The aerosol-generating system also comprises an aerosol-generating device configured to engage the cartridge. The aerosol-generating device comprises a power supply, and control circuitry. The control circuitry is configured to control a supply of power from the power supply to each of the heating elements to generate an aerosol. The control circuitry is configured to activate the heating elements in a sequence such that each heating element in the array is activated n times before any heating element in the array may be activated n+1 times, and such that, in the sequence, following an activation of a first heating element of the heating elements in the array, each subsequently activated heating element in the array is as far as possible from a most recently activated heating element in the array.

According to the second aspect, the control circuitry is configured to activate the heating elements in a sequence such that each heating element in the array is activated n times before any heating element in the array may be activated n+1 times. That is, before any heating element in the array may be activated an $n+1^{th}$ time, each element in the array must have been activated n times. Advantageously, this may give an activated heating element sufficient time to cool. This may reduce the likelihood of thermal decomposition of the aerosol-forming substrate.

According to the second aspect, the control circuitry is configured to activate the heating elements in a sequence such that each heating element in the array is activated n times before any heating element in the array may be activated n+1 times, and such that, in the sequence, following an activation of a first heating element of the heating elements in the array, each subsequently activated heating element in the array is as far as possible from a most recently activated heating element in the array. For example, starting from an array of heating elements in which no heating elements have been previously activated, after a first heating element is activated, the next heating element to be activated (i.e. the second heating element to be activated) is as far as possible from the first activated heating element. Then, the next heating element to be activated (i.e. the third heating element to be activated) is as far as possible from the second activated heating element and is not the first activated heating element. This process repeats until all of the heating elements in the cartridge have been activated. Advantageously, this may minimise preheating of the heating elements. That is, this may minimise the heating of a given heating element before the given heating element is activated. This may reduce the likelihood of thermal decomposition of the aerosol-forming substrate.

According to the second aspect, the first heating element to be activated may be chosen by the control circuitry such that no two consecutively activated heating elements are spatially adjacent.

According to the second aspect, the sequence of activation may comprise activation of each heating element in the array once, or more than once.

According to the second aspect, any sequence of activation may be implemented before the sequence of activation according to the second aspect starts. For example, where the array comprises five heating elements arranged in a row numbered sequentially from the start of the row to the end of the row as '1', '2', '3', '4', '5', and where the five heating elements have a constant spacing between them, an order of activation may be '1', '2', '3', '4', '5', '3', '1', '5', '2', '4'. In this order of activation, each heating element is activated twice, and for the second activation of each heating element, each subsequently activated heating element in the array is as far as possible from a most recently activated heating element in the array.

According to the second aspect, any sequence of activation may be implemented after the sequence of activation according to the second aspect starts. For example, where the array comprises five heating elements arranged in a row numbered sequentially from the start of the row to the end of the row as '1', '2', '3', '4', '5', and where the five heating elements have a constant spacing between them, an order of activation may be '3', '1', '5', '2', '4', '1', '2', '3', '4', '5'. In this order of activation, each heating element is activated twice, and for the first activation of each heating element, each subsequently activated heating element in the array is as far as possible from a most recently activated heating element in the array.

According to the second aspect, the activation of the first heating element of the heating elements in the array may be a first activation of any of the heating elements in the array after the aerosol-generating system is turned on. That is, the first heating element in the array may be the first heating element to be activated after the aerosol-generating system is turned on. In other words, the control circuitry may be configured to activate the heating elements in a sequence such that, in the sequence, following a first activation of any heating element in the array, each subsequently activated heating element in the array is as far as possible from a most recently activated heating element in the array, until each heating element in the array has been activated once. After each heating element has been activated once, the control circuitry may implement the same order of activation a second time, or may implement a different order of activation.

In this context, the term "the aerosol-generating system is turned on" may refer to the aerosol-generating system being in a state in which it is capable of delivering an aerosol to a user. As an example, the aerosol-generating system may have an on button, and a user may be required to press the on button before the power supply can supply power to the heating elements. As a specific example, a user may be required to press an on button before a flow sensor is turned on, such that the flow sensor may cooperate with the control circuitry to control the supply of power from the power supply to the heating elements.

Where there are an odd number of heating elements arranged in a row, the first heating element to be activated may be the middle heating element in the row of heating elements. For example, where there are five heating elements arranged in a row, and where these heating elements are numbered sequentially from the start of the row to the end of the row as '1', '2', '3', '4', '5', the first heating element to be activated may be heating element '3'.

Where there are an even number of heating elements arranged in a row, the first heating element to be activated may be one of the two middle heating elements in the row of heating elements. For example, where there are six heating elements arranged in a row, and where these heating elements are numbered sequentially from the start of the row to the end of the row as '1', '2', '3', '4', '5', '6', the first heating element to be activated may be either heating element '3' or heating element '4'.

According to the second aspect, it is possible that there will be more than one heating element as far as possible from the most recently activated heating element. That is, there may be two or more heating elements which are equidistant from the most recently activated heating element, and are all as far as possible from the most recently activated heating element. In this scenario, the immediately subsequently activated heating element may be an arbitrary choice between the heating elements equidistant from the most recently activated heating element. For example, where there are five heating elements arranged in a row numbered sequentially from the start of the row to the end of the row as '1', '2', '3', '4', '5', and where the five heating elements have a constant spacing between them, and where the first heating element to be activated is heating element '3', the second heating element to be activated may be an arbitrary choice between heating element '1' and heating element '5'. Alternatively, the control circuitry may choose the immediately subsequently activated heating element based on a criterion. For example, the control circuitry may subsequently activate a heating element which is furthest downstream of the air flow through the cartridge when a user takes a puff on the aerosol-generating system, or the control circuitry may subsequently activate a heating element which is furthest upstream of the air flow through the cartridge when a user takes a puff on the aerosol-generating system.

According to any aspect, the system may be configured to heat the heating elements to a temperature less than 200 degrees Centigrade, or less than 190 degrees Centigrade. Advantageously, this may reduce the likelihood of thermal decomposition of the aerosol-forming substrate on the heating elements, compared with heating the heating elements to higher temperatures.

The cartridge comprises heating elements arranged in an array. The cartridge according to any aspect may comprise at least eight, or at least ten, or at least twelve, or at least fifteen heating elements. Advantageously, a greater number of heating elements in a cartridge may mean that the cartridge lasts longer. That is, a greater number of heating elements may mean that the cartridge does not have to be replaced as frequently.

The control circuitry may be configured to activate each heating element only once. This may reduce the likelihood of thermal decomposition of the aerosol-forming substrate as aerosol-forming substrate is not reheated.

There may be a predetermined amount of aerosol-forming substrate on each heating element. Advantageously, this may allow better control over how much aerosol-forming substrate is heated each time a heating element is activated. In some embodiments, the predetermined amount is an amount configured to generate enough aerosol for only a single puff. That is, the predetermined amount of aerosol-forming substrate on a given heating element may provide a sufficient aerosol for one puff, but may not provide a sufficient aerosol for a second puff.

In other embodiments, the control circuitry may be configured to activate each heating element once before activating any heating element for a second time.

The heating elements may be heated by any suitable method. For example, at least one of, or each of, the heating elements may comprise an infra-red heating element, or an inductively heated heating element or susceptor, or an electrically resistive heating element, or a combination thereof.

Where at least one of, or each of, the heating elements comprises an electrically resistive heating element, the electrically resistive heating element preferably comprises an electrically resistive material. Suitable electrically resistive materials include, but are not limited to, semiconductors such as doped ceramics, electrically "conductive" ceramics (such as molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include Constantan, stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Del. 19898, United States of America.

Where at least one of, or each of, the heating elements comprises an inductively heated heating element, the heating element may be formed partially, or entirely, from one or more susceptor materials. Such an inductively heated heating element may be referred to herein as a susceptor. Suitable susceptor materials include, but are not limited to, graphite, molybdenum, silicon carbide, stainless steels, niobium, aluminium, nickel, nickel containing compounds, titanium, and composites of metallic materials. Preferred susceptor materials comprise a metal, metal alloy or carbon. Advantageously, susceptor materials may comprise a ferromagnetic material, for example, ferritic iron, a ferromagnetic alloy, such as ferromagnetic steel or stainless steel, ferromagnetic particles, and ferrite. A susceptor material may be, or may comprise, aluminium. A susceptor material preferably comprises more than 5 percent, preferably more than 20 percent, more preferably more than 50 percent or more than 90 percent of ferromagnetic or paramagnetic materials.

The aerosol-generating device or cartridge may advantageously comprise an inductive heater which, in use, partially or totally surrounds the susceptor. In use, the inductive heater inductively heats the inductively heated heating element.

The aerosol-generating device or cartridge may comprise an inductor coil disposed around at least a portion of the inductively heated heating element. In use, the power supply and the control circuitry may provide an alternating electric current to the inductor coil such that the inductor coil may generate an alternating magnetic field to heat the inductively heated heating element.

The control circuitry may be configured to supply power to the heating elements in response to a user inhalation. The control circuitry may comprise a flow sensor. The control circuitry may control the power supply to supply power to a heating element when the flow sensor detects that a flow rate of air flow through the cartridge has increased to more than an activation threshold. Advantageously, this removes a need for a user to activate the heating of the heating elements of the aerosol-generating system manually.

The control circuitry may control the power supply to supply power to each heating element for a fixed amount of time. For example, the control circuitry may control the power supply to supply power to each heating element for less than 2 seconds, or less than 1 second, or less than 0.5 seconds, or less than 0.2 seconds.

Alternatively, the control circuitry may control the power supply to supply power to a heating element until the flow sensor detects that the flow rate of air flow through the cartridge has reduced to less than a deactivation threshold.

Alternatively, the control circuitry may control the power supply to supply power to a heating element until the first of either of the following occurs:

the flow sensor detects that the flow rate of air flow through the cartridge has reduced to less than a deactivation threshold, or the power has been supplied to the heating element for longer than a fixed amount of time, for example longer than a period of 2 seconds, or 1 second, or 0.5 seconds, or 0.2 seconds.

At least one of, or each of, the heating elements may comprise a plate, or a tray, which is configured to be heated.

At least one of, or each of, the heating elements may comprise a blade which is configured to be heated.

At least one of, or each of, the heating elements may comprise a foil which is configured to be heated.

At least one of, or each of, the heating elements may comprise a mesh which is configured to be heated. The mesh may be configured to be electrically heated. The mesh may be configured to be inductively heated. The mesh may be configured to be heated in any suitable manner.

The mesh may comprise a heating filament arranged to overlap with itself. The heating filament may be arranged to overlap with itself in a serpentine, or tortuous, or both serpentine and tortuous, manner.

The mesh may comprise a plurality of heating filaments. Heating filaments may overlap with themselves, or with each other, or with both themselves and each other. Heating filaments may overlap with themselves, or with each other, or with both themselves and each other, in a serpentine, or tortuous, or both serpentine and tortuous manner.

The mesh may be entirely woven. The mesh may be entirely non-woven. The mesh may be partially woven and partially non-woven.

The mesh may comprise heating filaments which form a mesh of size between 160 and 600 Mesh US (+/−1-10%) (i.e. between 160 and 600 filaments per inch (+/−1-10%)).

The mesh may comprise a sheet with a plurality of holes, or a plurality of slots, or a plurality of interstices, or a combination thereof. Holes, slots and interstices may be arranged in the sheet in a regular pattern. The regular pattern may be a symmetrical pattern. Holes, slots and interstices may be arranged in the sheet in an irregular pattern.

The mesh may comprise heating filaments which are individually formed and then knitted together, or linked, or intertwined, or otherwise formed into the mesh.

The mesh may comprise heating filaments formed by etching a sheet of material, such as a foil.

The mesh may comprise heating filaments formed by stamping a sheet of material.

An open area percentage of the mesh may be between 15% and 60%, or between 25% and 56%. The term "open area percentage of the mesh" is used here to mean the ratio of the area of the interstices to the total area of the mesh. The term "open area percentage of the mesh" may refer to an open area percentage of a substantially flat mesh.

The mesh may be formed using any suitable type of weave or lattice structure.

The mesh may be substantially flat. As used herein, the term "substantially flat" may be used to mean formed in a single plane and not wrapped around or otherwise conformed to fit a curved or other non-planar shape. Advantageously, a substantially flat mesh can be easily handled during manufacture and provides for a robust construction.

Advantageously, the mesh may provide an enhanced heating contact area with the aerosol-forming substrate. This may improve the efficiency of heat transfer from the heating element to the aerosol-forming substrate compared with an aerosol-forming substrate on a foil heater.

The mesh may be partially, or entirely, formed from steel, preferably stainless steel. Advantageously, stainless steel is relatively electrically conductive, thermally conductive, inexpensive and inert.

The mesh may be partially, or entirely, formed from an iron-chromium-aluminium alloy such as Kanthal®, a nickel-chromium alloy, or nickel.

The mesh may comprise a plurality of interstices. The aerosol-forming substrate may be retained in the interstices. In this way, the mesh may provide distributed reservoirs of aerosol-forming substrate. Advantageously, a mesh comprising a plurality of interstices may be compatible with many forms of aerosol-forming substrate. For example, a mesh comprising a plurality of interstices may be compatible with liquid, gel, paste, and solid aerosol-forming substrates.

The interstices may have an average width of between 10 micrometres and 200 micrometres, or a width of between 10 micrometres and 100 micrometres.

The mesh may be formed at least partially from a plurality of electrically connected filaments. The plurality of electrically connected filaments may have an average diameter of between 5 micrometres and 200 micrometres, or an average diameter of between 8 micrometres and 200 micrometres, or an average diameter of between 8 micrometres and 100 micrometres, or an average diameter of between 8 micrometres and 50 micrometres.

The heating elements may comprise electrically resistive mesh which, when the cartridge is engaged with the aerosol-generating device, is electrically connected to the power supply. Advantageously, electrically resistive mesh may reach its operating temperature more quickly than other forms mesh, such as inductively heated mesh. This may reduce the time required to generate an adequate aerosol. Further, this may reduce the time that power must be supplied to the heating elements, which may consequently reduce the likelihood of thermal decomposition of the aerosol-forming substrate when the heating elements are heated.

Electrically resistive mesh preferably comprises an electrically resistive material. Suitable electrically resistive materials for an electrically resistive mesh include, but are not limited to, metal alloys such as steels and stainless steels, iron-chromium-aluminium alloys such as Kanthal®, nickel-chromium alloys, or nickel.

The aerosol-forming substrate on each of the heating elements may form an aerosol-forming substrate coating on each of the heating elements. For example, a gel or paste aerosol-forming substrate may be coated onto each of the heating elements to form a coating on each of the heating elements. As used herein, an aerosol-forming substrate coating may include aerosol-forming substrate retained in interstices in the mesh. One, or more than one, or all, of the aerosol-forming substrate coatings may be less than 30 microns in thickness, for example between 0.05 microns and 30 microns in thickness. One, or more than one, or all, of the aerosol-forming coatings may be less than 10 microns in thickness, or less than 8 microns in thickness, or less than 5 microns in thickness. Advantageously, thin coatings may allow rapid vaporisation of the aerosol-forming substrate when the heating element is heated. Further, this may reduce the likelihood of thermal decomposition of the aerosol-forming substrate when the heating elements are heated. This is because the likelihood of thermal decomposition of the substrate increases with the length of time of heating, and the heating element will not have to be heated for so long with a smaller thickness of substrate.

The aerosol-forming substrate may be applied to the heating elements by any suitable method. The suitability of a method for applying the aerosol-forming substrate may depend on the properties of the aerosol-forming substrate, for example the viscosity of the aerosol-forming substrate. The suitability of a method for applying the aerosol-forming substrate may depend on the desired thickness of the coating.

One exemplary method of applying an aerosol-forming substrate to a heating element comprises preparing a solution of the aerosol-forming substrate in a suitable solvent. The solution may comprise other desirable compounds, such as flavouring compounds. The method further comprises applying the solution to the heating elements, and then removing the solvent by evaporation or in any other suitable way. The suitability of a solvent for such a method may depend on the composition of the aerosol-forming substrate.

Alternatively, or in addition, the aerosol-forming substrate may be coated on the heating elements by dipping the heating elements into an aerosol-forming substrate or substrate solution, or by spraying, brushing, printing or otherwise applying the aerosol-forming substrate or substrate solution to the heating elements.

The aerosol-generating system may define an air inlet and an air outlet. A flow passage may be defined from the air inlet to the air outlet. In use, air may flow past, through or around the heating elements. In use, air may flow through the air inlet, then past, through or around the heating elements, and then through the air outlet. That is, a user taking a puff may cause air to flow through the air inlet, then past, through or around the heating elements, and then through the air outlet.

The cartridge may comprise a housing. The housing may define an air inlet and an air outlet. A flow passage may be defined from the air inlet to the air outlet. In use, air may flow past, through or around the heating elements. In use, air may flow through the air inlet, then past, through or around the heating elements, and then through the air outlet. That is, a user taking a puff may cause air to flow through the air inlet, then past, through or around the heating elements, and then through the air outlet.

The cartridge may comprise a housing which partially or completely surrounds the heating elements. In this context, the term "completely surrounds" is used to mean completely surrounding in a single plane. For example, an open ended cylinder with heating elements within the cylinder would "completely surround" the heating elements.

The cartridge may comprise a housing which is formed at least partially from a material which has a low thermal conductivity. The cartridge may comprise a housing which is substantially entirely, or entirely, formed from a material which has a low thermal conductivity. For example, more than 90% of the housing, or substantially all of the housing, may be formed from a material with a thermal conductivity less than 2 $W\ m^{-1}\ K^{-1}$, or 1 $W\ m^{-1}\ K^{-1}$, or less than 0.5 $W\ m^{-1}\ K^{-1}$, or less than 0.2 $W\ m^{-1}\ K^{-1}$. The cartridge housing may be formed from a plastic with low thermal conductivity. For example, the cartridge housing may be formed from polyether ether ketone (PEEK), polyethylene terephthalate (PET), polyethylene (PE), high-density polyethylene (HDPE), polypropylene (PP), polystyrene (PS), fluorinated ethylene propylene (FEP), polytetrafluoroethylene (PTFE), polyoxymethylene (POM), or a combination thereof.

Advantageously, a housing made from a low thermal conductivity material may help to minimise the preheating of heating elements. That is, a housing made from a low thermal conductivity material may help to minimise the preheating of heating elements which have not yet been heated. This is because less heat will be retained in the housing after a heating element has been heated. Minimising the preheating of a heating element may reduce the likelihood of thermal decomposition of the aerosol-forming substrate on the heating element.

The cartridge housing may be formed by any suitable method. Suitable methods include, but are not limited to, deep drawing, injection moulding, blistering, blow forming and extrusion.

The aerosol-generating device is configured to engage the cartridge. The aerosol-generating device is configured to engage the cartridge such that the power supply can supply power to each of the heating elements.

The aerosol-generating device may be configured to engage the cartridge such that, when the aerosol-generating device is engaged with the cartridge, the cartridge is temporarily fixed in place relative to the aerosol-generating device. That is, when the aerosol-generating device is engaged with the cartridge, the cartridge may have limited movement, for example be unable to move, relative to the aerosol-generating device until the aerosol-generating device is disengaged from the cartridge.

The aerosol-generating device may be configured to engage the cartridge in any suitable manner, for example using a screw-fitting, or a latch, or an interference fit.

The cartridge may be received in the aerosol-generating device.

The aerosol-generating system may comprise a mouthpiece through which generated aerosol is inhaled by a user. The cartridge may comprise a housing which forms the mouthpiece. The mouthpiece may include an air bypass hole such that air may flow into the aerosol-generating system and out of the mouthpiece without flowing through, past, or around the heating elements in the cartridge.

The aerosol-generating device may be portable. The aerosol-generating device may be a smoking device. The aerosol-generating device may have a size comparable to a conventional cigar or cigarette. The smoking device may have a total length between approximately 30 mm and approximately 150 mm. The aerosol-generating device may have an external diameter between approximately 5 mm and approximately 30 mm.

Features described in relation to one aspect may be applicable to another aspect. In particular, features described in relation to the first aspect may be applicable to the second aspect, and vice versa.

The invention will be further described, by way of example only, with reference to the accompanying drawings, in which.

Figure 1:
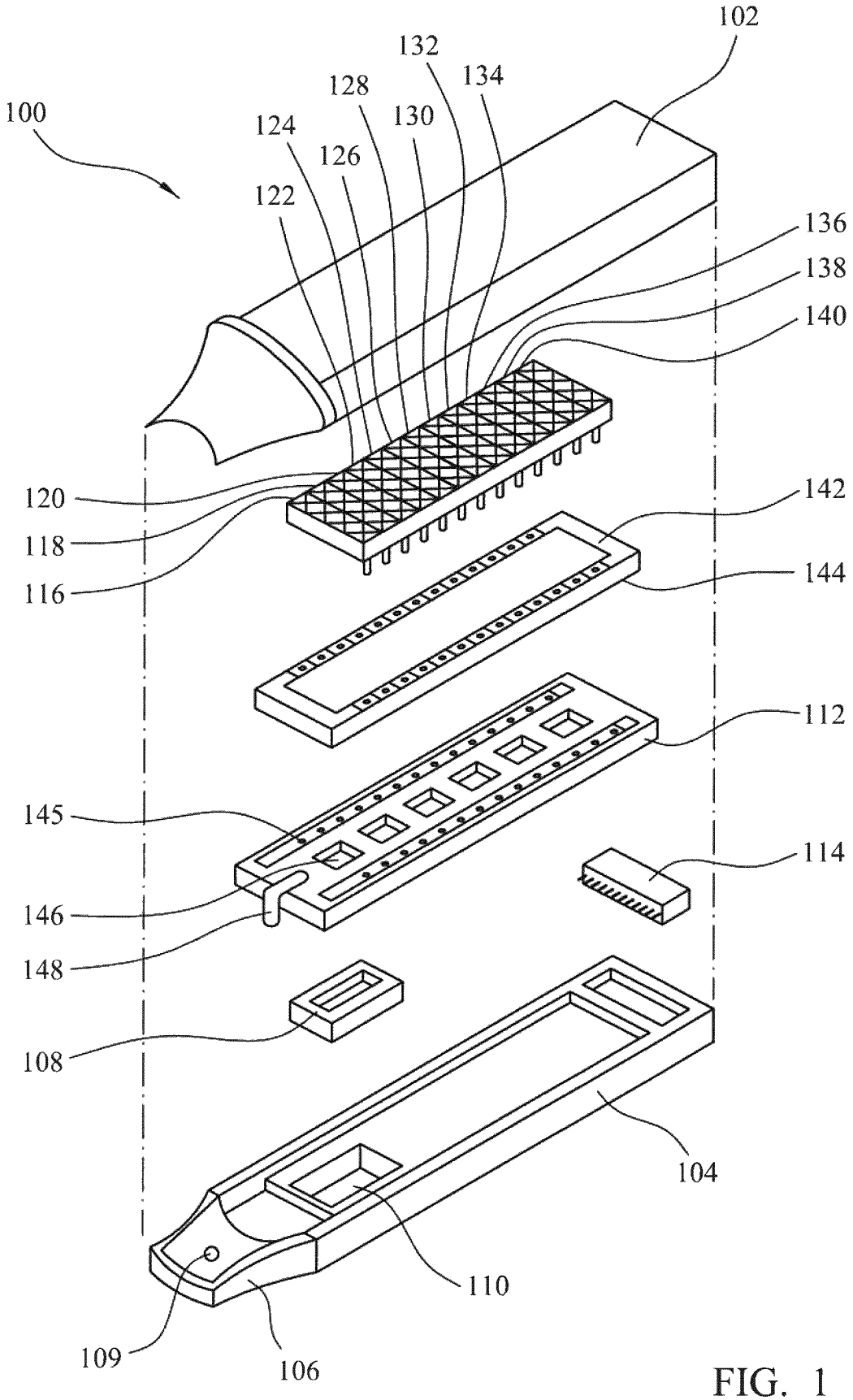
FIG. 1 is an exploded view of a cartridge for use in an aerosol-generating system according to the invention.

FIG. 1 is an exploded view of a cartridge for use in an aerosol-generating system according to the invention. The cartridge 100 comprises a first shell component 102 and a second shell component 104 which can be coupled together to form a cartridge housing. When the first shell component 102 and the second shell component 104 are coupled together, a mouth end of the first shell component 102 and a mouth end of the second shell component 104 form a mouthpiece 106 for insertion into a user's mouth.

The cartridge 100 comprises a cartridge air inlet valve 108 which, when the cartridge is assembled, is located adjacent to a cartridge air inlet 110. In this embodiment, the cartridge air inlet valve 108 is a flapper valve which, due to its flexibility, bends in response to a pressure differential across the valve. However, any suitable valve such as an umbrella valve or a reed valve or the like may be used. An air bypass hole 109 is located in the second shell component 104 to allow air to enter the mouthpiece 106 when a flow rate of an air flow through the cartridge 100 is greater than a flow rate controlled by the cartridge air inlet valve 108. For example, an average user may puff on the mouthpiece 106 of the cartridge 100 at a flow rate between 30 L/min and 100 L/min and the cartridge inlet valve 108 may consequently allow a flow rate of between 5 L/min and 8 L/min through. The excess flow rate may enter the air bypass hole 109.

The cartridge 100 further comprises a Printed Circuit Board (PCB) 112 enabling electrical connection between a cartridge connector 114 and a plurality of electrically resistive heating elements 116, 118, 120, 122, 124, 126, 128, 130, 132, 134, 136, 138, 140. The heating elements each comprise an electrically conductive stainless steel mesh. The stainless steel mesh is formed by an interlaced network of stainless steel filaments. The filaments have diameters around 40 micrometres. The mesh forms a plurality of interstices with an average width of around 80 micrometres for retaining aerosol-forming substrate. The heating elements are mounted on a thermally insulating spacer 142. The spacer comprises a plurality of holes 144 which allows the heating elements to be soldered to connection points 145 disposed on the PCB 112. The PCB 112 comprises a plurality of holes 146 which air may flow through.

The cartridge 100 further comprises a flow sensor 148 which is configured to measure the flow rate of an air flow through the cartridge air inlet 110.

Each of the electrically resistive heating elements is coated with an aerosol-forming substrate. In this embodiment, the aerosol-forming substrate comprises a nicotine source.

The aerosol-forming substrate is deposited onto the heating elements by preparing a solution of the aerosol-forming substrate and a methanol solvent, applying the solution to the heating elements, and then vaporising the solvent at a low temperature, for example at 25 degrees Centigrade. Aerosol-forming substrate is retained in the interstices of the heating elements.

Figure 2:
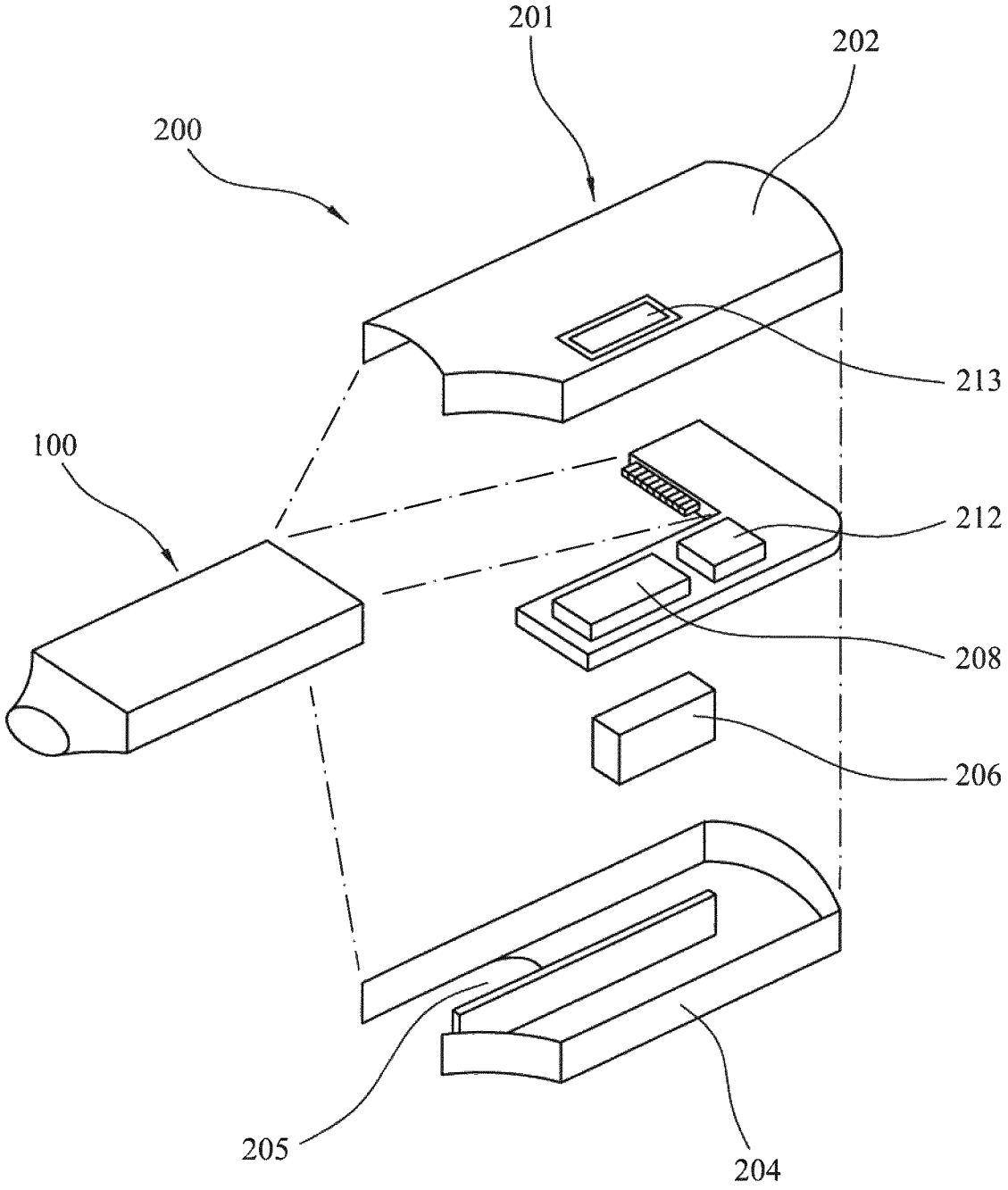
FIG. 2 is an exploded view of an aerosol-generating system according to the invention.

FIG. 2 is an exploded view of an aerosol-generating system according to the invention. The aerosol-generating system 200 comprises the cartridge 100 shown in FIG. 1 and a device 201. The device 201 comprises a first device component 202 and a second device component 204. The first device component 202 and the second device component 204 can be coupled together. The second device component 204 comprises a recess 205. When the system is assembled, air may flow through the recess 205 and into the cartridge air inlet 110.

The device 201 further comprises a power supply 206 connected to a display 208, and control circuitry 212, and a device connector 214 for electrically connecting the power supply 206 and the control circuitry 212 to the heating elements and the flow sensor 148 in the cartridge 100. The first device component 202 comprises a transparent window 213 such that, when the device 201 is assembled, the display 208 can be seen through the transparent window 213 of the first device component 202. The display 208 may show information such as how many heating elements have been used, how many heating elements remain unused, how much nicotine has been delivered during the current smoking session, or how much nicotine has been delivered in a given time period such as the current month. The aerosol-generating system includes a user interface (not shown) to allow the user to access different types of information.

In this embodiment, the power supply 206 is a lithium ion battery, though there are many alternative suitable power supplies which could be used.

Figure 3:
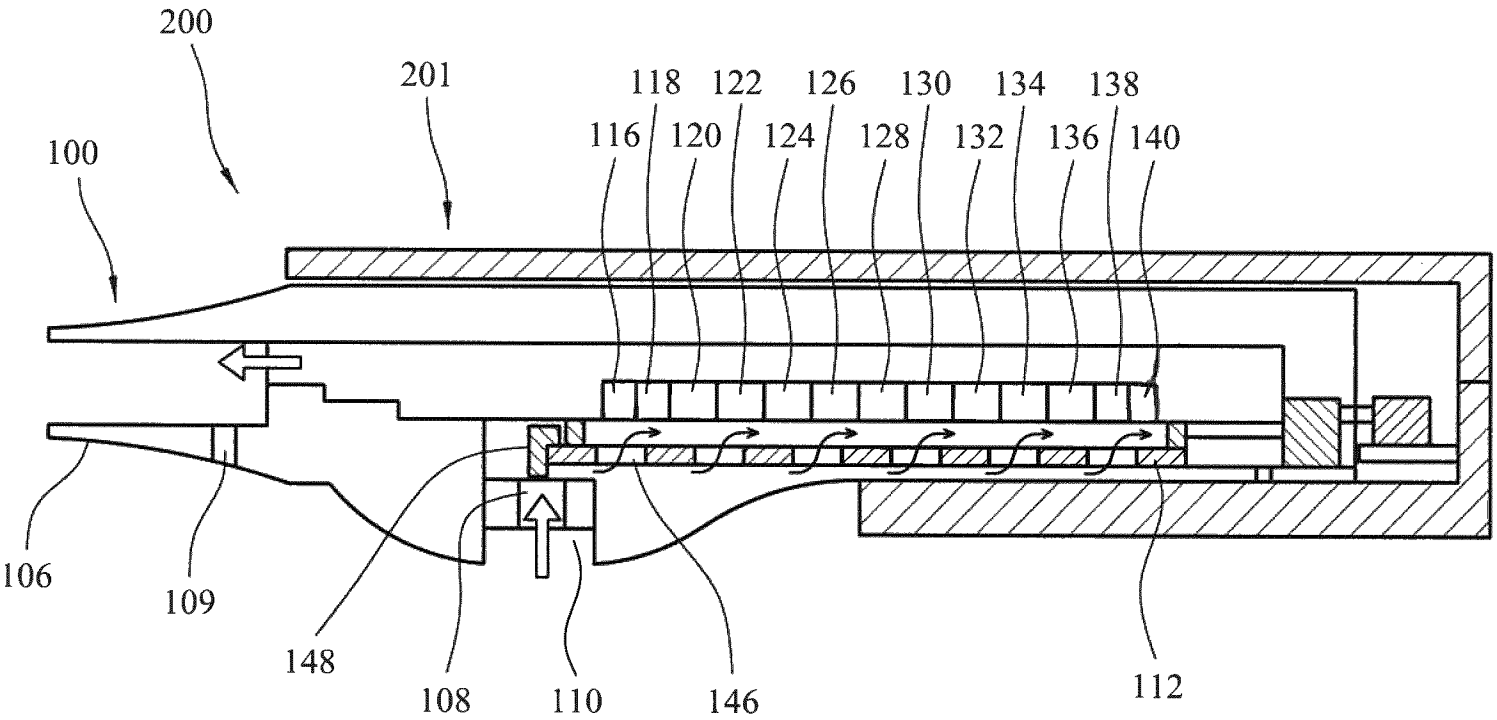
FIG. 3 is a cross-sectional view of an aerosol-generating system according to the invention.

FIG. 3 is a cross-sectional view of an aerosol-generating system according to the invention. The aerosol-generating system 200 shown in FIG. 3 is the same as that shown in FIG. 2. The cross-section is located through the cartridge 100 in order to show the heating elements in the cartridge. In this cross-section, the power supply, the display and the control circuitry cannot be seen.

In use, the aerosol-generating system 200 operates as follows.

The user turns on the system 200 using a button (not shown). The user puffs on the mouthpiece 106 of the cartridge 100. This causes a flow of air through the device recess, through the cartridge air inlet 110, and through the cartridge inlet valve 108. This air flow is detected by the flow sensor 148. There may also be a flow of air through the air bypass hole 109.

When the flow sensor 148 detects that the flow rate of air through the cartridge air inlet 110 is greater than an activation threshold, the control circuitry controls the power supply to supply power to a first heating element 116. This heats the mesh of the first heating element 116 to approximately 180 degrees Centigrade. This causes the aerosol-forming substrate retained in the interstices of the mesh of the first heating element 116 to vaporise, so aerosol particles are formed. The aerosol particles comprise nicotine from the nicotine source.

The air flow through the cartridge air inlet 110 flows through the plurality of holes 146 in the PCB 112. This air flow then flows across the heating elements, including the first heating element 116. The air flow entrains vaporised aerosol particles to form an aerosol which is subsequently delivered to the user via the mouthpiece 106.

The control circuitry controls the power supply to reduce the power supplied to the first heating element 116 to zero. In this embodiment, power is supplied to the heating element for a fixed time period of 0.5 seconds.

This process may repeat during the same smoking session, or over the course of multiple smoking sessions. In consequence of the flow sensor 148 detecting each subsequent puff on the aerosol-generating system, the control circuitry will control the power supply to supply power to each subsequent heating element.

In this embodiment, the order in which the control circuitry activates each of the heating elements in response to a detected puff is as follows: 116, 120, 124, 128, 132, 136, 140, 118, 122, 126, 130, 134, 138. No two spatially adjacent heating elements are ever heated consecutively. There are numerous other orders in which the control circuitry 212 could control the power supply 206 to the heating elements such that no two spatially adjacent heating elements are activated consecutively. There must be at least four heating elements for the control circuitry to be able to implement an order of activation in which no two spatially adjacent heating elements are activated consecutively.

As a second example order of activation, it may be advantageous to maximise the smallest spatial distance between any two consecutively activated heating elements. Thus, the order of activation could be: 116, 130, 118, 132, 120, 134, 122, 136, 124, 138, 126, 140, 128.

In this context, "two consecutively activated heating elements" may refer to an $n^{th}$ and an $m^{th}$ heating element in a single cartridge which are activated without another heating element being activated between the activation of the $n^{th}$ and $m^{th}$ heating elements. This includes activation of a heating element in a different smoking session, for example on a different day to the most recently activated heating element.

As a third example order of activation, it may be advantageous to activate the heating elements sequentially such that, following activation of a first heating element of the heating elements in the array, each subsequently activated heating element in the array is as far as possible from a most recently activated heating element in the array. Thus, the order of activation could be: 128, 140, 116, 138, 118, 136, 120, 134, 122, 132, 124, 130, 126.

As a fourth example order of activation, it may be advantageous to activate the heating elements sequentially such that, following an activation of a first heating element of the heating elements in the array, each subsequently activated heating element in the array is activated only once and is as far as possible from a most recently activated heating element in the array. It may also be advantageous for the first activated heating element to be situated furthest downstream in the cartridge. With a linear array, it is impossible to attain both of these advantages and ensure that no two spatially adjacent heating elements are activated consecutively. The fourth order of activation could be: 116, 140, 118, 138, 120, 136, 122, 134, 124, 132, 126, 130, 128.

Advantageously, all of the embodiments of the claimed invention described herein provide an improved aerosol-generating system in which the likelihood of thermal decomposition of an aerosol-forming substrate is reduced.

The invention claimed is:

1. An aerosol-generating system comprising:

a cartridge, the cartridge comprising:

a heater assembly comprising at least four individually activatable heating elements arranged in an array, and an aerosol-forming substrate on each of the heating elements; and an aerosol-generating device configured to engage the cartridge, the aerosol-generating device comprising:

a power supply, and control circuitry;

wherein the control circuitry is configured to control a supply of power from the power supply to each of the heating elements to generate an aerosol, and wherein the control circuitry is configured to activate the heating elements sequentially such that no two spatially adjacent heating elements are activated consecutively.

2. An aerosol-generating system according to claim 1, wherein the control circuitry is configured to activate the heating elements in an order which maximises the minimum distance between any two consecutively activated heating elements.

3. An aerosol-generating system according claim 1, wherein the control circuitry is configured to activate the heating elements sequentially such that each subsequently activated heating element in the array, other than a first activated heating element, is as far as possible from a most recently activated heating element in the array.

4. An aerosol-generating system comprising:

a cartridge, the cartridge comprising:

a heater assembly comprising at least three individually activatable heating elements arranged in an array, and an aerosol-forming substrate on each of the heating elements; and an aerosol-generating device configured to engage the cartridge, the aerosol-generating device comprising:

a power supply, and control circuitry;

wherein the control circuitry is configured to control a supply of power from the power supply to each of the heating elements to generate an aerosol, and wherein the control circuitry is configured to activate the heating elements in a sequence such that each heating element in the array is activated n times before any heating element in the array may be activated n+1 times, and such that, in the sequence, following an activation of a first heating element of the heating elements in the array, each subsequently activated heating element in the array is as far as possible from a most recently activated heating element in the array.

5. An aerosol-generating system according to claim 4, wherein the first heating element is chosen such that no two consecutively activated heating elements are spatially adjacent.

6. An aerosol-generating system according to claim 4, wherein the activation of the first heating element of the heating elements in the array is a first activation of any of the heating elements in the array after the aerosol-generating system is turned on.

7. An aerosol-generating system according to claim 1, wherein the system is configured to heat each of the heating elements to a temperature less than 200 degrees centigrade.

8. An aerosol-generating system according to claim 1, wherein the control circuitry is configured to supply power to at least one of the one or more heating element in response to a user inhalation.

9. An aerosol-generating system according to claim 1, wherein the cartridge comprises at least eight heating elements.

10. An aerosol-generating system according to claim 1, wherein each of the heating elements is configured to be activated only once.

11. An aerosol-generating system according to claim 1, wherein there is a predetermined amount of aerosol-forming substrate on each of the heating elements.

12. An aerosol-generating system according to claim 1, wherein each of the heating elements comprises a mesh and the aerosol-forming substrate is in direct contact with the mesh.

13. An aerosol-generating system according to claim 12, wherein the mesh comprises a plurality of interstices and the aerosol-forming substrate is retained in the interstices.

* * * * *